US010594028B2

(12) United States Patent
Yong et al.

(10) Patent No.: US 10,594,028 B2
(45) Date of Patent: Mar. 17, 2020

(54) ANTENNA ARRAYS HAVING MULTI-LAYER SUBSTRATES

(71) Applicant: Apple Inc., Cupertino, CA (US)

(72) Inventors: Siwen Yong, San Francisco, CA (US); Yi Jiang, Cupertino, CA (US); Jiangfeng Wu, San Jose, CA (US); Lijun Zhang, San Jose, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/895,482

(22) Filed: Feb. 13, 2018

(65) Prior Publication Data

US 2019/0252771 A1 Aug. 15, 2019

(51) Int. Cl.

| | |
|---|---|
| ***H01Q 19/06*** | (2006.01) |
| ***H01Q 1/52*** | (2006.01) |
| ***H01Q 1/24*** | (2006.01) |
| ***H01Q 21/22*** | (2006.01) |
| ***H01Q 5/30*** | (2015.01) |

(52) U.S. Cl.

CPC ..... *H01Q 1/523* (2013.01); *H01Q 1/243* (2013.01); *H01Q 5/30* (2015.01); *H01Q 21/22* (2013.01)

(58) Field of Classification Search

CPC .... H01Q 1/523; H01Q 9/0457; H01Q 9/0485; H01Q 21/0075; H01Q 25/005; H01Q 21/24; H01Q 5/10; H01Q 1/38; H01Q 21/08; H01Q 21/22; H01Q 1/243; H01Q 5/30

USPC ..... 343/785, 893, 824, 911 R, 700 MS, 762, 343/774

See application file for complete search history.

(56) References Cited

U.S. PATENT DOCUMENTS

| | | | | |
|---|---|---|---|---|
| 5,872,534 A * | 2/1999 | Mayer | H01Q 17/00 342/1 |
| 6,075,485 A * | 6/2000 | Lilly | H01Q 1/38 343/700 MS |
| 7,626,547 B2 | 12/2009 | Schillmeier et al. | |
| 7,800,542 B2 | 9/2010 | Li et al. | |
| 8,564,472 B2 * | 10/2013 | Okamura | H01Q 1/526 342/1 |
| 8,643,184 B1 * | 2/2014 | Zhang | H01P 3/081 257/758 |

(Continued)

*Primary Examiner* — Linh V Nguyen

(74) *Attorney, Agent, or Firm* — Treyz Law Group, P.C.; Michael H. Lyons; Tianyi He

(57) ABSTRACT

An electronic device may be provided with a phased antenna array for conveying millimeter wave signals. The array may be mounted to a substrate that includes transmission line layers having a first dielectric permittivity and antenna layers having a second dielectric permittivity that is less than the first dielectric permittivity. A ground plane may be interposed between the antenna layers and the transmission line layers. The array may be mounted to the antenna layers and transceiver circuitry may be mounted to the transmission line layers. Transmission line traces may be formed on the transmission line layers. The relatively high permittivity of the first set of dielectric layers may allow the transmission line traces to be routed relatively close together with minimal electromagnetic interference. The relatively low permittivity of the second set of dielectric layers may allow the array to operate with satisfactory antenna efficiency, gain, and bandwidth.

19 Claims, 10 Drawing Sheets

(56) References Cited

U.S. PATENT DOCUMENTS

| | | | | |
|---|---|---|---|---|
| 8,659,913 | B2 | 2/2014 | van Dijk et al. | |
| 8,766,855 | B2 | 7/2014 | Biglarbegian et al. | |
| 9,629,112 | B2 * | 4/2017 | Bauchot | H04W 56/0015 |
| 9,692,112 | B2 * | 6/2017 | Ying | H01Q 1/523 |
| 2002/0057222 | A1 * | 5/2002 | McKinzie, III | H01O 1/38 343/700 MS |
| 2011/0133978 | A1 * | 6/2011 | Sim | H01Q 17/00 342/1 |
| 2016/0294068 | A1 * | 10/2016 | Djerafi | H01Q 1/38 |
| 2018/0182525 | A1 * | 6/2018 | Sprentall | H01F 10/30 |
| 2018/0205155 | A1 * | 7/2018 | Mizunuma | H01Q 1/38 |

* cited by examiner

ANTENNA ARRAYS HAVING MULTI-LAYER SUBSTRATES

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. In order to support millimeter and centimeter wave communications, an array of antennas is formed on a substrate. Transmission lines for the array are embedded within the substrate.

Operation at these frequencies may support high bandwidths, but may raise significant challenges. For example, it can be difficult to ensure that the transmission lines on the substrate are sufficiently isolated from each other at millimeter wave frequencies. Forming the transmission lines far apart from each other typically improves isolation. However, at the same time, manufacturers are continually striving to implement wireless communications circuitry such as antenna arrays using compact structures to satisfy consumer demand for small form factor wireless devices.

It would therefore be desirable to be able to provide electronic devices with improved wireless communications circuitry such as communications circuitry that supports millimeter wave communications.

SUMMARY

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antennas may be arranged in a phased antenna array.

The phased antenna array and the transceiver circuitry may be mounted to a shared substrate to form an antenna module. The substrate may include a first set of dielectric layers (e.g., one or more dielectric layers) having a first dielectric permittivity and a second set of dielectric layers (e.g., one or more dielectric layers) having a second dielectric permittivity that is less than the first dielectric permittivity. A ground plane for the phased antenna array may be interposed between the first and second sets of dielectric layers. The transceiver circuitry may be mounted to the second set of dielectric layers. Transmission lines for the phased antenna array may be formed from conductive traces on the first set of dielectric layers. The phased antenna array may be formed on the second set of dielectric layers (e.g., the antenna resonating elements of the phased antenna array may be mounted to a surface of the second set of dielectric layers). If desired, the second set of dielectric layers may include a first subset of dielectric layers having the first permittivity and a second subset of dielectric layers having a third permittivity that is lower than the second permittivity (e.g., the second permittivity may be a bulk permittivity derived from the cumulative effects of both the first permittivity of the first subset of layers and the third permittivity of the second subset of layers). The first subset of layers may be interleaved among the second subset of layers.

The relatively high permittivity of the first set of dielectric layers may allow the transmission lines to be routed relatively close together without electromagnetically interfering with each other. The relatively low permittivity of the second set of dielectric layers may allow the phased antenna array to operate with satisfactory antenna efficiency, gain, and bandwidth. The permittivity of the second set of dielectric layers may be adjusted (e.g., using the interleaving subsets of layers) to change the thickness of the second set of layers to accommodate different device form factors if desired.

DETAILED DESCRIPTION

Figure 1:
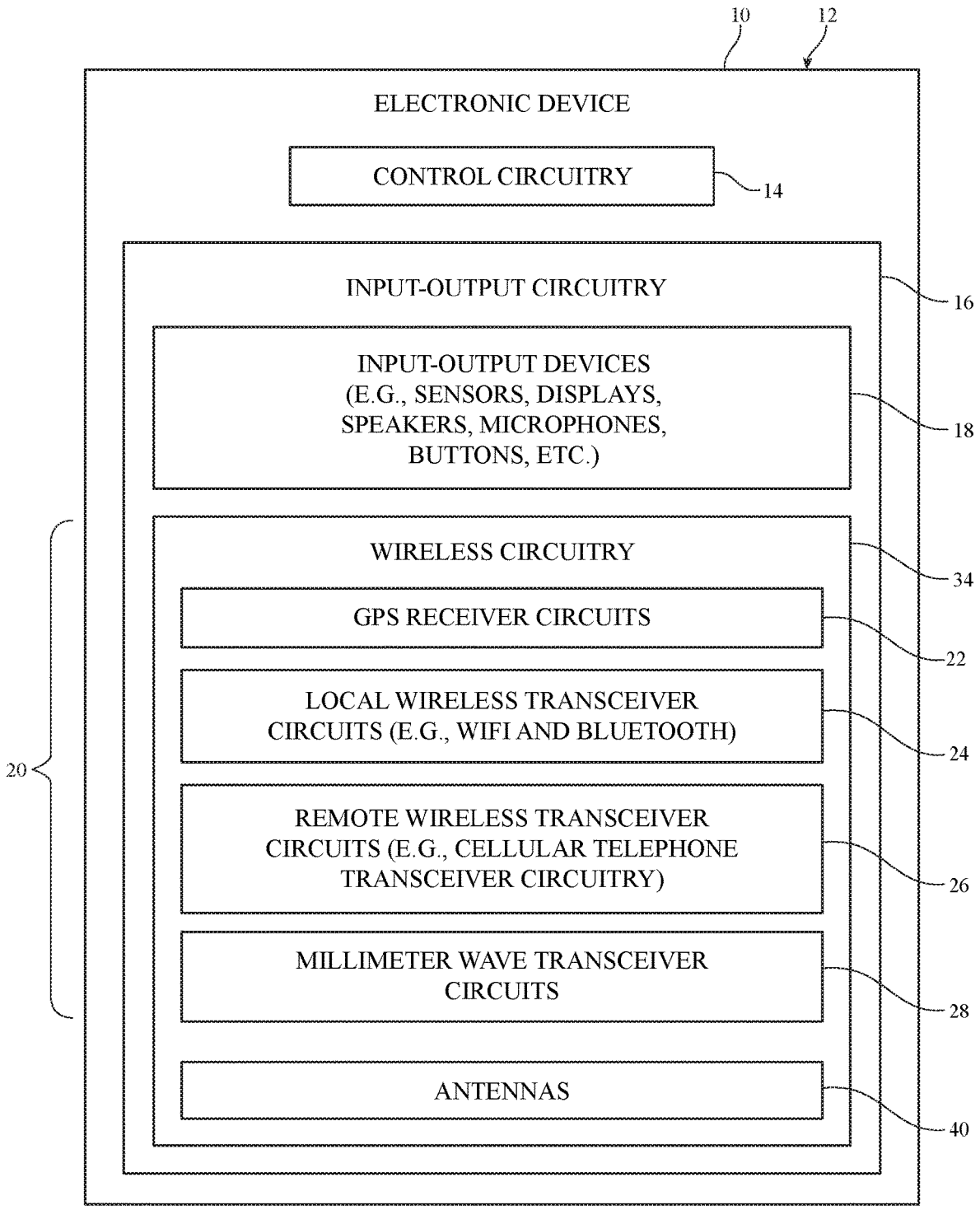
FIG. 1 is a schematic diagram of an illustrative electronic device with wireless communications circuitry in accordance with an embodiment.

Electronic devices such as electronic device 10 of FIG. 1 may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. While uses of millimeter wave communications may be described herein as examples, centimeter wave communications, EHF communications, or any other types of communications may be similarly used. If desired, electronic devices may also contain wireless communications circuitry for handling satellite navigation system signals, cellular telephone signals, local wireless area network signals, near-field communications, light-based wireless communications, or other wireless communications.

Electronic devices (such as device 10 in FIG. 1) may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station (e.g., a wireless router or other equipment for routing communications between other wireless devices and a larger network such as the internet or a cellular telephone network), a desktop computer, a keyboard, a gaming controller, a computer mouse, a mousepad, a trackpad or touchpad, equipment that implements the functionality of two or more of these devices, or other electronic equipment. The above-mentioned examples are merely illustrative. Other configurations may be used for electronic devices if desired.

FIG. 1 is a schematic diagram showing illustrative components that may be used in an electronic device such as electronic device 10. As shown in FIG. 1, device 10 may include storage and processing circuitry such as control circuitry 14. Control circuitry 14 may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other wireless personal area network protocols, IEEE 802.1 lad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include radio-frequency transceiver circuitry 20 for handling various radio-frequency communications bands. For example, circuitry 34 may include transceiver circuitry 22, 24, 26, and 28.

Transceiver circuitry 24 may be wireless local area network transceiver circuitry. Transceiver circuitry 24 may handle 2.4 GHz and 5 GHz bands for Wi-Fi® (IEEE 802.11) communications or other wireless local area network (WLAN) bands and may handle the 2.4 GHz Bluetooth® communications band or other wireless personal area network (WPAN) bands.

Circuitry 34 may use cellular telephone transceiver circuitry 26 for handling wireless communications in frequency ranges such as a low communications band from 600 to 960 MHz, a midband from 1710 to 2170 MHz, a high band from 2300 to 2700 MHz, an ultra-high band from 3400 to 3700 MHz, or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a K, communications band between about 26.5 GHz and 40 GHz, a Ku communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11 ad communications at 60 GHz and/or 5th generation mobile networks or 5th generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., transceiver circuitry 28 may transmit and receive radio-frequency signals in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In Wi-Fi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals that travel (over short distances) between a transmitter and a receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, stacked patch antenna structures, antenna structures having parasitic elements, inverted-F antenna structures, slot antenna structures, planar inverted-F antenna structures, monopoles, dipoles, helical antenna structures, Yagi (Yagi-Uda) antenna structures, surface integrated waveguide structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can be arranged in phased antenna arrays for handling millimeter wave and centimeter wave communications.

As shown in FIG. 1, device 10 may include a housing such as housing 12. Housing 12, which may sometimes be referred to as an enclosure or case, may be formed of plastic, glass, ceramics, fiber composites, metal (e.g., stainless steel, aluminum, metallic coatings on a substrate, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Antennas 40 may be mounted in housing 12. Dielectric-filled openings such as plastic-filled openings may be formed in metal portions of housing 12 (e.g., to serve as antenna windows and/or to serve as gaps that separate portions of antennas 40 from each other).

In scenarios where input-output devices 18 include a display, the display may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures. The display may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. The display may be protected using a display cover layer such as a layer of transparent glass, clear plastic, sapphire, or other transparent dielectric. If desired, some of the antennas 40 (e.g., antenna arrays that may implement beam steering, etc.) may be mounted under an inactive border region of the display. The display may contain an active area with an array of pixels (e.g., a central rectangular portion). Inactive areas of the display are free of pixels and may form borders for the active area. If desired, antennas may also operate through dielectric-filled openings elsewhere in device 10.

If desired, housing 12 may include a conductive rear surface. The rear surface of housing 12 may lie in a plane that is parallel to a display of device 10. In configurations for device 10 in which the rear surface of housing 12 is formed from metal, it may be desirable to form parts of peripheral conductive housing structures as integral portions of the housing structures forming the rear surface of housing 12. For example, a rear housing wall of device 10 may be formed from a planar metal structure, and portions of peripheral housing structures on the sides of housing 12 may be formed as vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions. The peripheral housing structures and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide internal structures from view of the user).

Transmission line paths may be used to route antenna signals within device 10. For example, transmission line paths may be used to couple antennas 40 to transceiver circuitry 20. Transmission line paths in device 10 may include coaxial cable paths, microstrip transmission lines, stripline transmission lines, edge-coupled microstrip transmission lines, edge-coupled stripline transmission lines, waveguide structures for conveying signals at millimeter wave frequencies (e.g., coplanar waveguides or grounded coplanar waveguides), transmission lines formed from combinations of transmission lines of these types, etc.

Transmission line paths in device 10 may be integrated into rigid and/or flexible printed circuit boards if desired. In one suitable arrangement, transmission line paths in device 10 may include transmission line conductors (e.g., signal and/or ground conductors) that are integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40 if desired.

In some configurations, antennas 40 may include antenna arrays (e.g., phased antenna arrays to implement beam steering functions). For example, the antennas that are used in handling millimeter wave signals for extremely high frequency wireless transceiver circuits 28 may be implemented as phased antenna arrays. The radiating elements in a phased antenna array for supporting millimeter wave communications may be patch antennas, dipole antennas, Yagi (Yagi-Uda) antennas, or other suitable antenna elements. Transceiver circuitry 28 can be integrated with the phased antenna arrays to form integrated phased antenna array and transceiver circuit modules or packages (sometimes referred to herein as integrated antenna modules or antenna modules) if desired.

In devices such as handheld devices, the presence of an external object such as the hand of a user or a table or other surface on which a device is resting has a potential to block wireless signals such as millimeter wave signals. In addition, millimeter wave communications typically require a line of sight between antennas 40 and the antennas on an external device. Accordingly, it may be desirable to incorporate multiple phased antenna arrays into device 10, each of which is placed in a different location within or on device 10. With this type of arrangement, an unblocked phased antenna array may be switched into use and, once switched into use, the phased antenna array may use beam steering to optimize wireless performance. Similarly, if a phased antenna array does not face or have a line of sight to an external device, another phased antenna array that has line of sight to the external device may be switched into use and that phased antenna array may use beam steering to optimize wireless performance. Configurations in which antennas from one or more different locations in device 10 are operated together may also be used (e.g., to form a phased antenna array, etc.).

Figure 2:
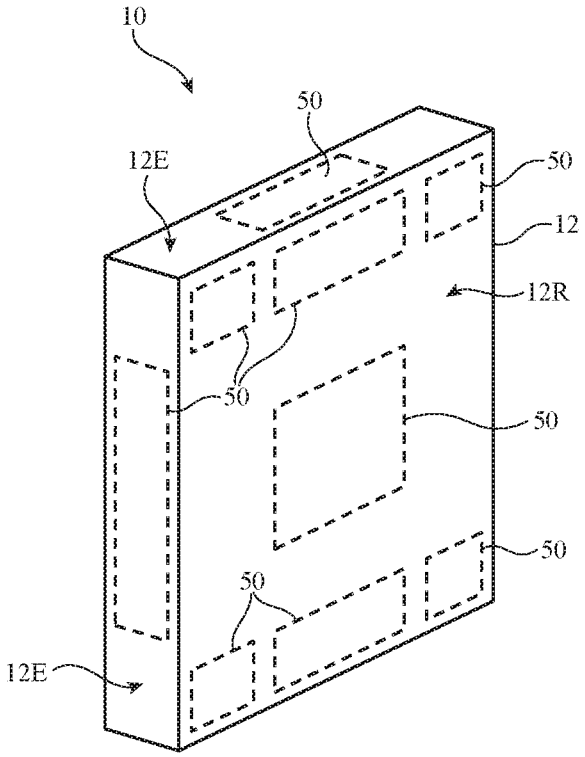
FIGS. 2 and 3 are perspective views of an illustrative electronic device showing locations at which phased antenna arrays for millimeter wave communications may be located in accordance with an embodiment.

FIG. 2 is a perspective view of electronic device 10 showing illustrative locations 50 at which antennas 40 (e.g., single antennas and/or phased antenna arrays for use with wireless circuitry 34 such as millimeter wave wireless transceiver circuitry 28 in FIG. 1) may be mounted in device 10. As shown in FIG. 2, housing 12 of device 10 may include rear housing wall 12R (sometimes referred to as wall 12R, rear housing portion 12R, or rear housing surface 12R) and housing sidewalls 12E. In one suitable arrangement, a display may be mounted to the side of housing 12 opposing rear housing wall 12R.

Antennas 40 (e.g., single antennas 40 or arrays of antennas 40) may be mounted at locations 50 at the corners of device 10, along the edges of housing 12 such as on sidewalls 12E, on the upper and lower portions of rear housing wall 12R, in the center of rear housing 12 (e.g., under a dielectric window structure such as a plastic logo), etc. In configurations in which housing 12 is formed from a dielectric, antennas 40 may transmit and receive antenna signals through the dielectric, may be formed from conductive structures patterned directly onto the dielectric, or may be formed on dielectric substrates (e.g., flexible printed circuit board substrates) formed on the dielectric. In configurations in which housing 12 is formed from a conductive material such as metal, slots or other openings may be formed in the metal that are filled with plastic or other dielectric. Antennas 40 may be mounted in alignment with the dielectric (i.e., the dielectric in housing 12 may serve as one or more antenna windows for antennas 40) or may be formed on dielectric substrates (e.g., flexible printed circuit board substrates) mounted to external surfaces of housing 12.

Figure 3:
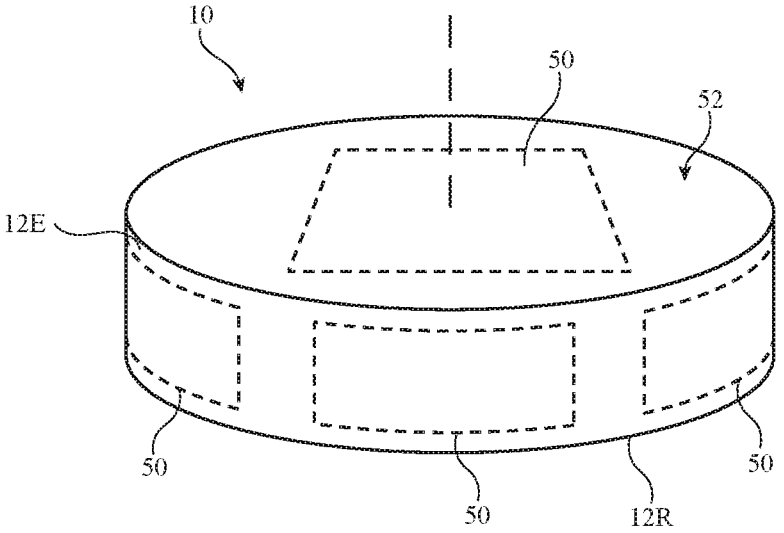

In the example of FIG. 2, rear housing wall 12R has a rectangular periphery. Housing sidewalls 12E surround the rectangular periphery of rear housing wall 12R and extend from rear housing wall 12R to the opposing face of device 10. In another suitable arrangement, device 10 and housing 12 may have a cylindrical shape. As shown in FIG. 3, rear housing wall 12R has a circular or elliptical periphery. Rear housing wall 12R may oppose surface 52 of device 10. Surface 52 may be formed from a portion of housing 12, may be formed from a display or transparent display cover layer, or may be formed using any other desired device structures. Housing sidewall 12E may extend between surface 52 and rear housing wall 12R. Antennas 40 may be mounted at locations 50 along housing sidewall 12E, on surface 52, and/or on rear housing wall 12R. By forming phased antenna arrays at different locations along housing sidewall 12E, on surface 52 (sometimes referred to herein as housing surface 52), and/or on rear housing wall 12R (e.g., as shown in FIGS. 2 and 3), the different phased antenna arrays on device 10 may collectively provide line of sight coverage to any point on a sphere surrounding device 10 (or on a hemisphere surrounding device 10 in scenarios where phased antenna arrays are only formed on one side of device 10).

The examples of FIGS. 2 and 3 are merely illustrative. In general, housing 12 and device 10 may have any desired shape or form factor. For example, rear housing wall 12R may have a triangular periphery, hexagonal periphery, polygonal periphery, a curved periphery, combinations of these, etc. Housing sidewall 12E may include straight portions, curved portions, stepped portions, combinations of these, etc. If desired, housing 12 may include other portions having any other desired shapes. The height of housing sidewall 12E may be less than, equal to, or greater than the length and/or width of rear housing wall 12R.

Figure 4:
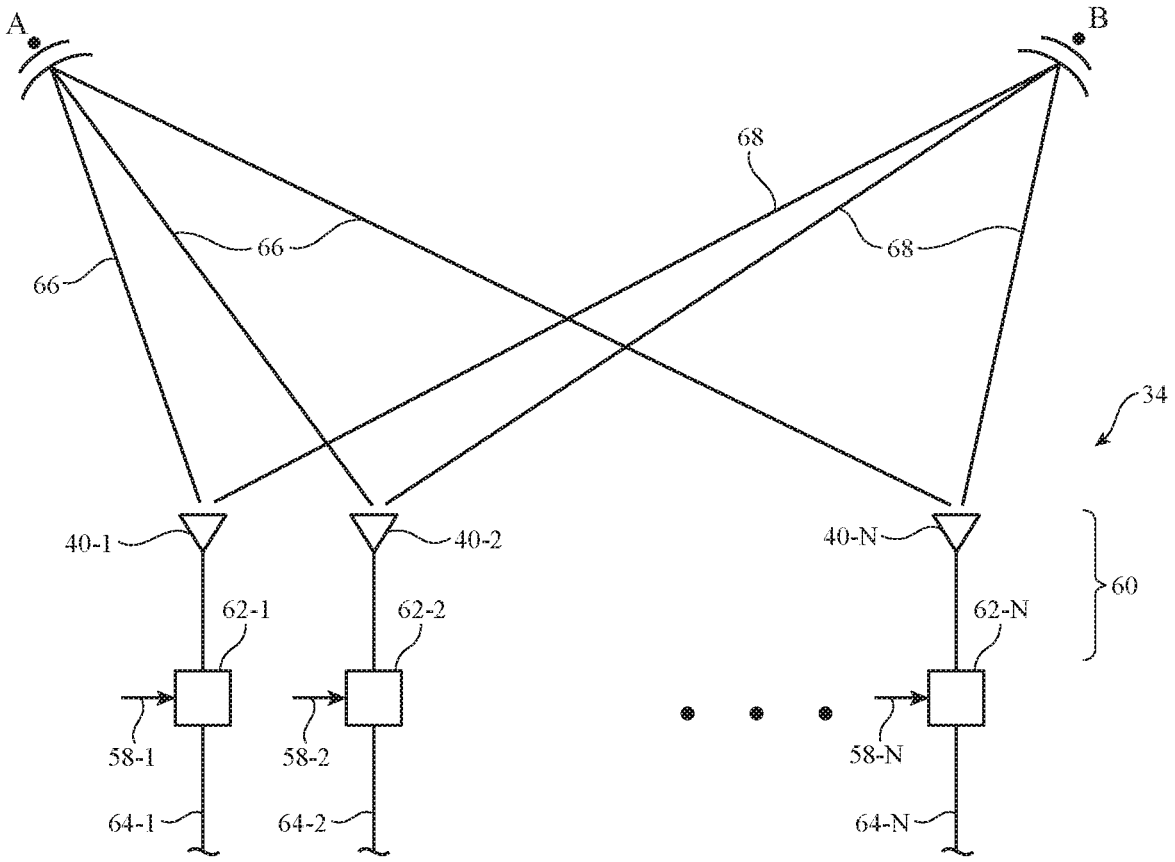
FIG. 4 is a diagram of an illustrative phased antenna array that may be adjusted using control circuitry to direct a beam of signals in accordance with an embodiment.

FIG. 4 shows how antennas 40 on device 10 may be formed in a phased antenna array. As shown in FIG. 4, phased antenna array 60 (sometimes referred to herein as array 60, antenna array 60, or array 60 of antennas 40) may be coupled to signal paths such as transmission line paths 64 (e.g., one or more radio-frequency transmission lines). For example, a first antenna 40-1 in phased antenna array 60 may be coupled to a first transmission line path 64-1, a second antenna 40-2 in phased antenna array 60 may be coupled to a second transmission line path 64-2, an Nth antenna 40-N in phased antenna array 60 may be coupled to an Nth transmission line path 64-N, etc. While antennas 40 are described herein as forming a phased antenna array, the antennas 40 in phased antenna array 60 may sometimes be referred to as collectively forming a single phased array antenna.

Antennas 40 in phased antenna array 60 may be arranged in any desired number of rows and columns or in any other desired pattern (e.g., the antennas need not be arranged in a grid pattern having rows and columns). During signal transmission operations, transmission line paths 64 may be used to supply signals (e.g., radio-frequency signals such as millimeter wave and/or centimeter wave signals) from transceiver circuitry 28 (FIG. 1) to phased antenna array 60 for wireless transmission to external wireless equipment. During signal reception operations, transmission line paths 64 may be used to convey signals received at phased antenna array 60 from external equipment to transceiver circuitry 28 (FIG. 1).

The use of multiple antennas 40 in phased antenna array 60 allows beam steering arrangements to be implemented by controlling the relative phases and magnitudes (amplitudes) of the radio-frequency signals conveyed by the antennas. In the example of FIG. 4, antennas 40 each have a corresponding radio-frequency phase and magnitude controller 62 (e.g., a first phase and magnitude controller 62-1 interposed on transmission line path 64-1 may control phase and magnitude for radio-frequency signals handled by antenna 40-1, a second phase and magnitude controller 62-2 interposed on transmission line path 64-2 may control phase and magnitude for radio-frequency signals handled by antenna 40-2, an Nth phase and magnitude controller 62-N interposed on transmission line path 64-N may control phase and magnitude for radio-frequency signals handled by antenna 40-N, etc.).

Phase and magnitude controllers 62 may each include circuitry for adjusting the phase of the radio-frequency signals on transmission line paths 64 (e.g., phase shifter circuits) and/or circuitry for adjusting the magnitude of the radio-frequency signals on transmission line paths 64 (e.g., power amplifier and/or low noise amplifier circuits). Phase and magnitude controllers 62 may sometimes be referred to collectively herein as beam steering circuitry (e.g., beam steering circuitry that steers the beam of radio-frequency signals transmitted and/or received by phased antenna array 60).

Phase and magnitude controllers 62 may adjust the relative phases and/or magnitudes of the transmitted signals that are provided to each of the antennas in phased antenna array 60 and may adjust the relative phases and/or magnitudes of the received signals that are received by phased antenna array 60 from external equipment. Phase and magnitude controllers 62 may, if desired, include phase detection circuitry for detecting the phases of the received signals that are received by phased antenna array 60 from external equipment. The term "beam" or "signal beam" may be used herein to collectively refer to wireless signals that are transmitted and received by phased antenna array 60 in a particular direction. The term "transmit beam" may sometimes be used herein to refer to wireless radio-frequency signals that are transmitted in a particular direction whereas the term "receive beam" may sometimes be used herein to refer to wireless radio-frequency signals that are received from a particular direction.

If, for example, phase and magnitude controllers 62 are adjusted to produce a first set of phases and/or magnitudes for transmitted millimeter wave signals, the transmitted signals will form a millimeter wave frequency transmit beam as shown by beam 66 of FIG. 4 that is oriented in the direction of point A. If, however, phase and magnitude controllers 62 are adjusted to produce a second set of phases and/or magnitudes for the transmitted millimeter wave signals, the transmitted signals will form a millimeter wave frequency transmit beam as shown by beam 68 that is oriented in the direction of point B. Similarly, if phase and magnitude controllers 62 are adjusted to produce the first set of phases and/or magnitudes, wireless signals (e.g., millimeter wave signals in a millimeter wave frequency receive beam) may be received from the direction of point A as shown by beam 66. If phase and magnitude controllers 62 are adjusted to produce the second set of phases and/or magnitudes, signals may be received from the direction of point B, as shown by beam 68.

Each phase and magnitude controller 62 may be controlled to produce a desired phase and/or magnitude based on a corresponding control signal 58 received from control circuitry 14 of FIG. 1 or other control circuitry in device 10 (e.g., the phase and/or magnitude provided by phase and magnitude controller 62-1 may be controlled using control signal 58-1, the phase and/or magnitude provided by phase and magnitude controller 62-2 may be controlled using control signal 58-2, etc.). If desired, control circuitry 14 may actively adjust control signals 58 in real time to steer the transmit or receive beam in different desired directions over time. Phase and magnitude controllers 62 may provide information identifying the phase of received signals to control circuitry 14 if desired.

When performing millimeter or centimeter wave communications, radio-frequency signals are conveyed over a line of sight path between phased antenna array 60 and external equipment. If the external equipment is located at location A of FIG. 4, phase and magnitude controllers 62 may be adjusted to steer the signal beam towards direction A. If the external equipment is located at location B, phase and magnitude controllers 62 may be adjusted to steer the signal beam towards direction B. In the example of FIG. 4, beam steering is shown as being performed over a single degree of freedom for the sake of simplicity (e.g., towards the left and right on the page of FIG. 4). However, in practice, the beam is steered over two or more degrees of freedom (e.g., in three dimensions, into and out of the page and to the left and right on the page of FIG. 4).

Figure 5:
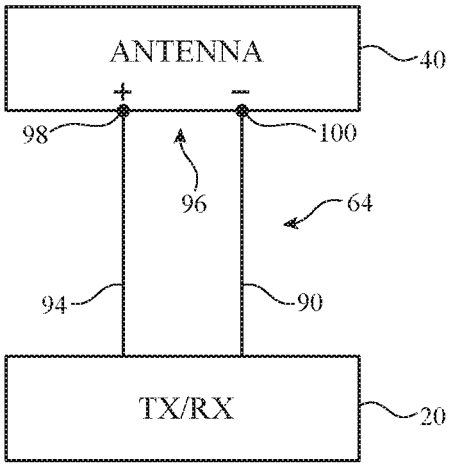
FIG. 5 is a schematic diagram of illustrative wireless communications circuitry in accordance with an embodiment.

A schematic diagram of an antenna 40 that may be formed in phased antenna array 60 (e.g., as antenna 40-1, 40-2, 40-3, and/or 40-N in phased antenna array 60 of FIG. 4) is shown in FIG. 5. As shown in FIG. 5, antenna 40 may be coupled to transceiver circuitry 20 (e.g., millimeter wave transceiver circuitry 28 of FIG. 1). Transceiver circuitry 20 may be coupled to antenna feed 96 of antenna 40 using transmission line path 64 (sometimes referred to herein as radio-frequency transmission line 64). Antenna feed 96 may include a positive antenna feed terminal such as positive antenna feed terminal 98 and may include a ground antenna feed terminal such as ground antenna feed terminal 100. Transmission line path 64 may include a positive signal conductor such as signal conductor 94 that is coupled to terminal 98 and a ground conductor such as ground conductor 90 that is coupled to terminal 100.

Any desired antenna structures may be used for implementing antenna 40. In one suitable arrangement that is sometimes described herein as an example, patch antenna structures may be used for implementing antenna 40. Antennas 40 that are implemented using patch antenna structures may sometimes be referred to herein as patch antennas. An illustrative patch antenna that may be used in phased antenna array 60 of FIG. 4 is shown in FIG. 6.

Figure 6:
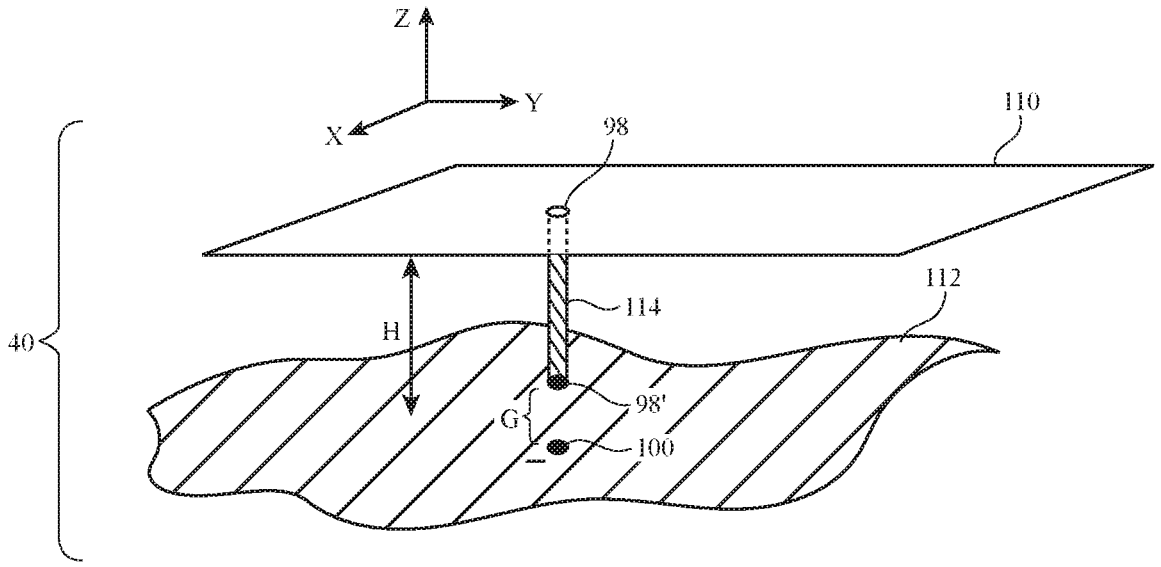
FIG. 6 is a perspective view of an illustrative patch antenna in accordance with an embodiment.

As shown in FIG. 6, antenna 40 may have a patch antenna resonating element such as patch element 110 that is separated from a ground plane structure such as ground 112 (sometimes referred to as ground layer 112, grounding layer 112, or antenna ground 112). Patch element 110 and ground 112 may be formed from metal foil, machined metal structures, metal traces on a printed circuit or a molded plastic carrier, electronic device housing structures, or other conductive structures in an electronic device such as device 10. Patch element 110 may sometimes be referred to herein as patch 110, patch antenna resonating element 110, patch radiating element 110, or antenna resonating element 110.

Patch element 110 may lie within a plane such as the X-Y plane of FIG. 5. Ground 112 may lie within a plane that is parallel to the plane of patch element 110. Patch element 110 and ground 112 may therefore lie in separate parallel planes that are separated by a distance H. In general, greater distances (heights) H may allow antenna 40 to exhibit a greater bandwidth than shorter distances H. However, greater distances H may consume more volume within device 10 (where space is often at a premium) than shorter distances H.

Conductive path 114 may be used to couple terminal 98' to positive antenna feed terminal 98. Antenna 40 may be fed using a transmission line with a positive conductor coupled to terminal 98' (and thus to positive antenna feed terminal 98) and with a ground conductor coupled to ground antenna feed terminal 100. Other feeding arrangements may be used if desired. Moreover, patch element 110 and ground 112 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.).

Figure 7:
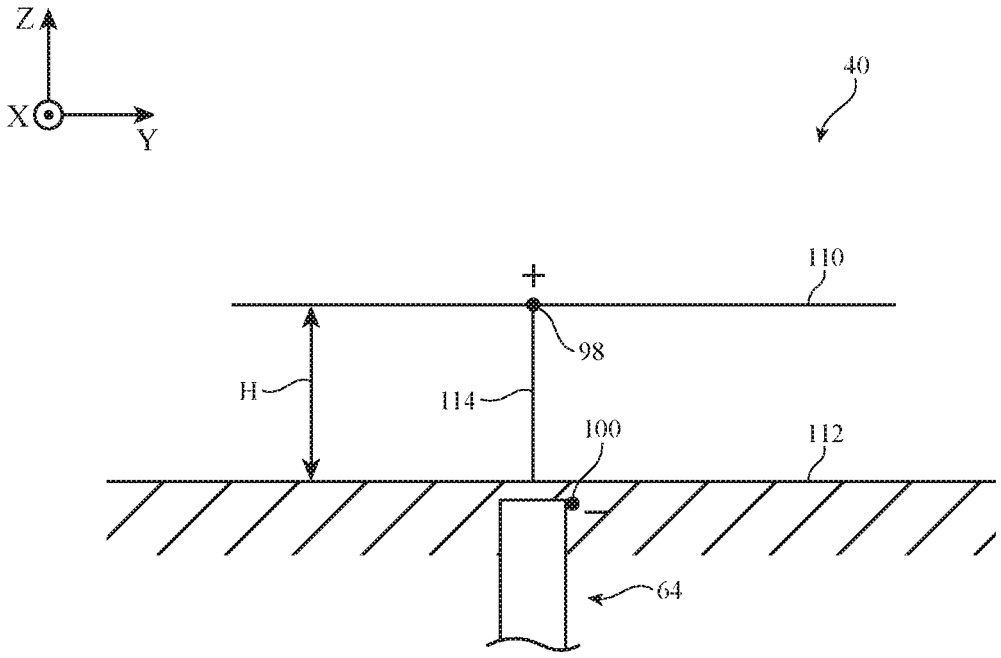
FIG. 7 is a side view of an illustrative patch antenna in accordance with an embodiment.

A side view of a patch antenna such as antenna 40 of FIG. 6 is shown in FIG. 7. As shown in FIG. 7, antenna 40 may be fed using an antenna feed (with antenna feed terminals 98 and 100) that is coupled to a transmission line such as transmission line 64. Patch element 110 of antenna 40 may lie in a plane parallel to the X-Y plane of FIG. 7 and the surface of the structures that form ground (e.g., ground 112) may lie in a plane that is separated by vertical distance H from the plane of patch element 110.

With the illustrative feeding arrangement of FIG. 7, a ground conductor of transmission line 64 (e.g., ground conductor 90 of FIG. 5) is coupled to ground antenna feed terminal 100 on ground 112 and a positive conductor of transmission line 64 (e.g., signal conductor 94 of FIG. 5) is coupled to positive antenna feed terminal 98 via an opening in ground 112 and conductive path 114 (which may be an extended portion of the transmission line's positive conductor). Conductive path 114 may be implemented using conductive pins, solder, welds, conductive wires, conductive springs, conductive through-vias, and/or any other desired conductive structures. Other feeding arrangements may be used if desired (e.g., feeding arrangements in which a microstrip transmission line in a printed circuit or other transmission line that lies in a plane parallel to the X-Y plane is coupled to terminals 98 and 100, etc.). To enhance the frequency coverage and polarizations handled by antenna 40, antenna 40 may be provided with multiple feeds (e.g., two feeds) if desired. These examples are merely illustrative and, in general, the patch element may have any desired shape. Other types of antennas may be used if desired.

Antennas of the types shown in FIGS. 6 and 7 and/or other types of antennas such as dipole antennas and Yagi antennas may be arranged in a phased antenna array such as phased antenna array 60 (FIG. 4). If desired, phased antenna array 60 may be integrated with other circuitry such as transceiver circuitry 20 to form an integrated antenna module.

Figure 8:
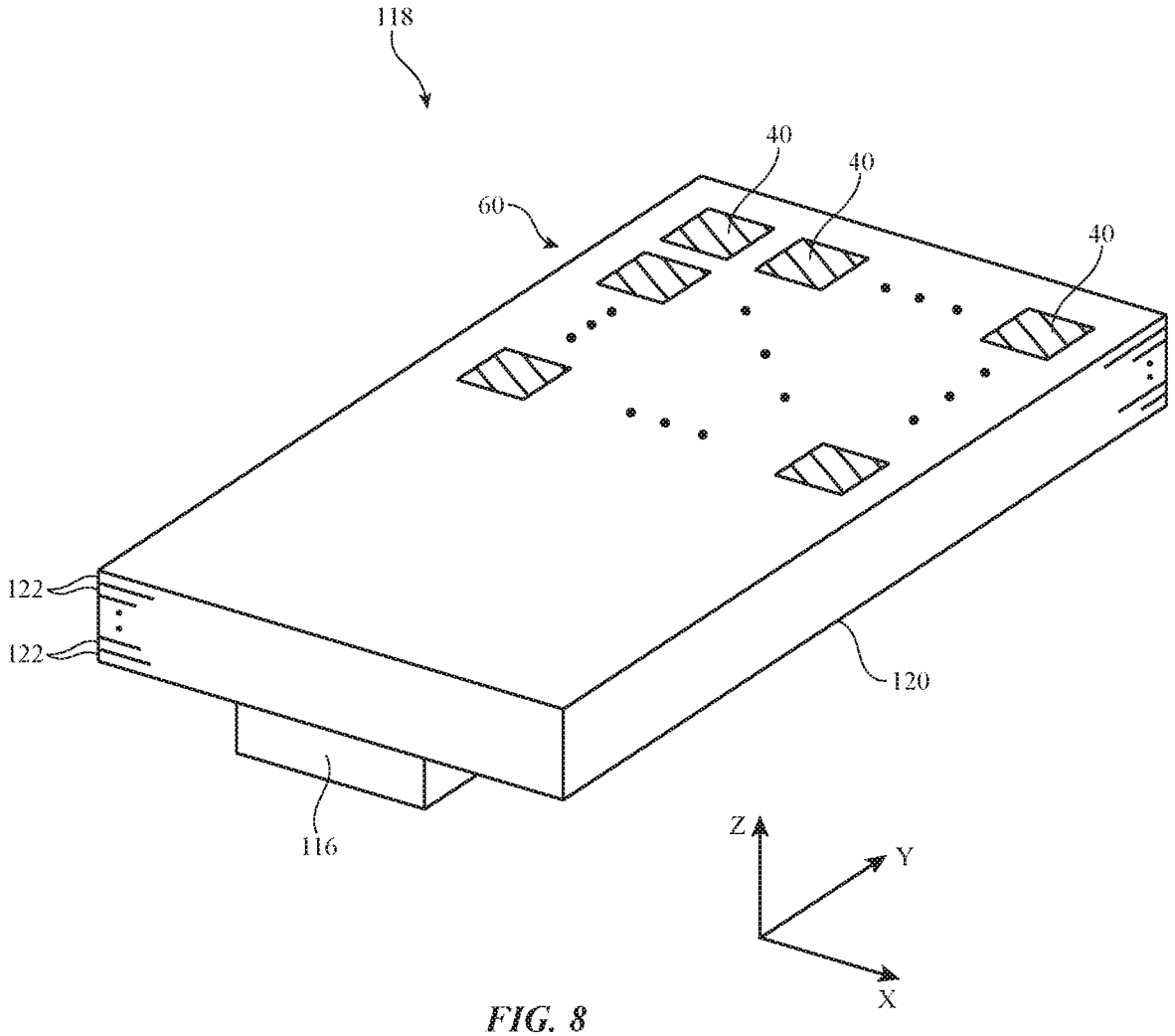
FIG. 8 is a perspective view of an illustrative antenna module in accordance with an embodiment.

FIG. 8 is a perspective view of an illustrative integrated antenna module for handling signals at frequencies greater than 10 GHz in device 10 (e.g., millimeter wave signals). As shown in FIG. 8, device 10 may be provided with an integrated antenna module such as integrated antenna module 118 (sometimes referred to herein as antenna module 118 or module 118). Module 118 may include phased antenna array 60 of antennas 40 formed on a dielectric substrate such as dielectric substrate 120. Substrate 120 may be, for example, a rigid or printed circuit board or other dielectric substrate. Substrate 120 may be a stacked dielectric substrate that includes multiple stacked dielectric layers 122 (e.g., multiple layers of printed circuit board substrate such as multiple layers of fiberglass-filled epoxy, rigid printed circuit board material, flexible printed circuit board material, ceramic, plastic, glass, or other dielectrics). Phased antenna array 60 may include any desired number of antennas 40 arranged in any desired pattern. Additional phased antenna arrays 60 may be provided on the top and/or bottom surface of substrate 120 if desired.

Antennas 40 in phased antenna array 60 may include elements such as patch elements 110, ground 112, and/or other components such as parasitic elements that are interposed between or formed on layers 122 of substrate 120. One or more electrical components 116 (e.g., transceiver circuitry such as transceiver circuitry 20 or transceiver circuitry 28 of FIG. 1) may be mounted on substrate 120. For example, components 116 may be mounted on a surface of substrate 120 such as the surface of substrate 120 opposite phased antenna array 60 or the same surface of substrate 120 on which phased antenna array 60 is formed. Components 116 may, for example, include integrated circuits (e.g., integrated circuit chips) or integrated circuit packages mounted to substrate 120. Components 116 may sometimes be referred to herein as transceivers 116, transceiver circuitry 116, or transceiver chips 116. If desired, components 116 may include control circuitry (e.g., some or all of circuitry 14 of FIG. 1) or any other desired electrical components.

Conductive traces or other metal layers on substrate 120 may be used in forming transmission line structures such as transmission line paths 64 of FIGS. 4, 5, and 7. Conductive traces for forming transmission line paths 64 may be interposed between layers 122 of substrate 120. The transmission lines may be used to convey radio-frequency antenna signals at frequencies greater than 10 GHz such as millimeter wave signals between transceiver circuitry 116 and antennas 40 in phased antenna array 60. For example, a respective transmission line path 64 may be coupled between each antenna 40 in module 118 and transceiver circuitry 116.

In practice, radio-frequency signals at relatively high frequencies such as frequencies greater than 10 GHz may be particularly susceptible to attenuation over relatively large distances. Mounting transceiver circuitry 116 to the same substrate as phased antenna array 60 (i.e., substrate 120 of module 18) may allow transceiver circuitry 116 to be located relatively close to phased antenna array 60, thereby minimizing signal attenuation between transceiver circuitry 116 and phased antenna array 60. At the same time, as the number of antennas 40 implemented on module 118 and the number of frequencies covered by phased antenna array 60 increases, the routing complexity of the corresponding transmission line paths increases. If care is not taken, it can be difficult to ensure that each of the transmission line paths in module 118 is sufficiently isolated from the other transmission line paths in module 118. While placing the transmission line paths far apart from each other may serve to enhance isolation, doing so would cause the transmission lines and module 118 to occupy an excessive amount of space within device 10 (where space is at a premium). It would therefore be desirable to be able to minimize the volume of module 118 while still allowing for a satisfactory amount of isolation between the transmission line paths routed over substrate 120.

In order to maximize isolation between transmission line paths 64 while minimizing the size of module 118, the material used to form layers 122 may be selected to have a relatively high dielectric permittivity. Relatively high dielectric permittivity materials may minimize the electromagnetic influence of radio-frequency signals conveyed along transmission line paths 64 from other transmission line paths 64 in substrate 120. However, at the same time, relatively high dielectric permittivity materials can lead to generation of surface waves at patch elements 110 and may serve to undesirably limit the bandwidth of antennas 40 in phased antenna array 60. It would therefore be desirable to be able to provide modules 118 that minimize the volume of module 118 while still allowing for satisfactory antenna performance and a satisfactory amount of isolation between the transmission line paths on substrate 120.

Figure 9:
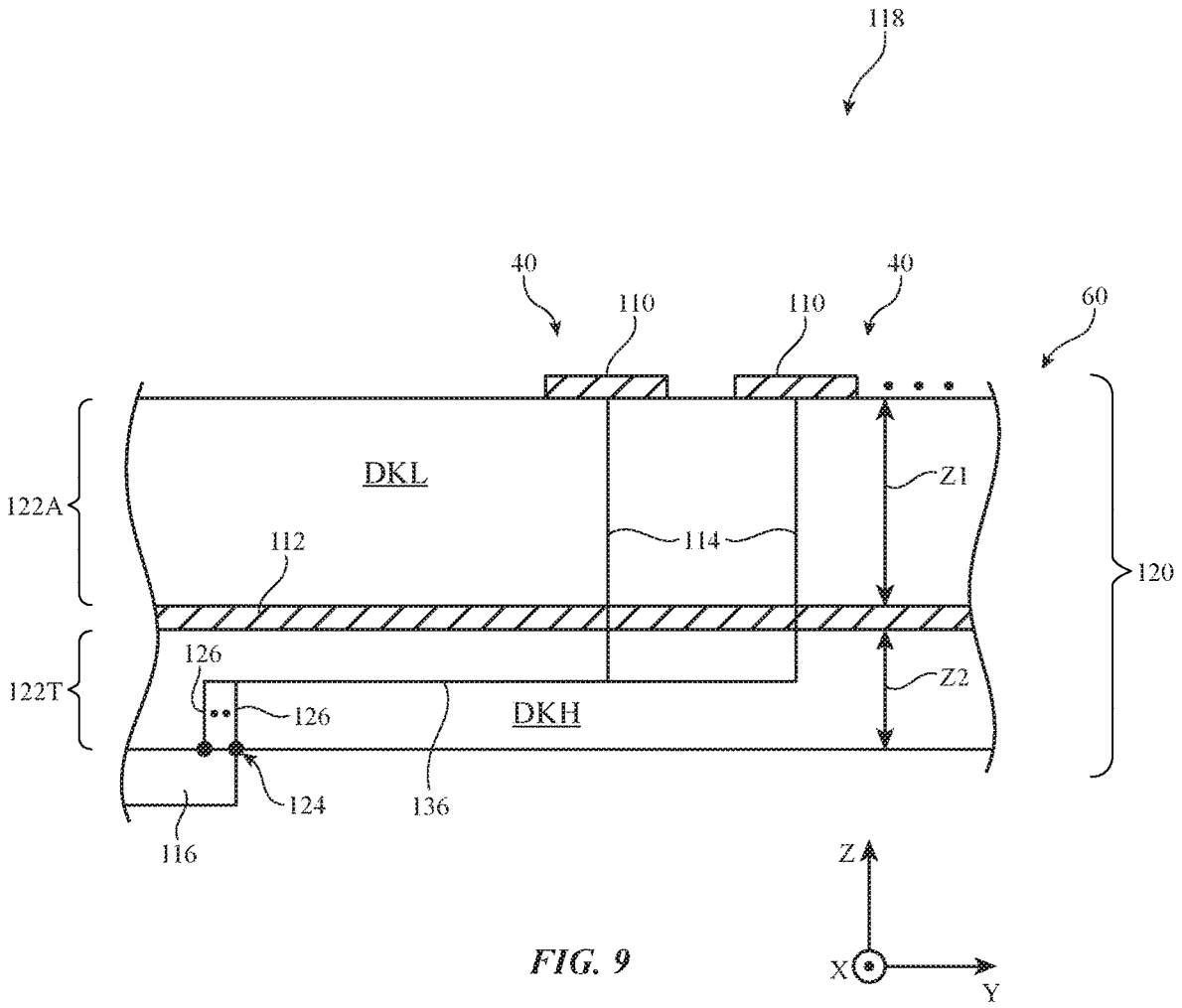
FIG. 9 is a cross-sectional side view of an illustrative antenna module having transmission line layers and antenna layers with different dielectric permittivities in accordance with an embodiment.

FIG. 9 is a cross-sectional side view of module 118 that exhibits satisfactory antenna bandwidth and transmission line isolation while minimizing space consumption within device 10. As shown in FIG. 9, patch elements 110 of antennas 40 in phased antenna array 60 may be formed at a first (top) surface of substrate 120. Transceiver circuitry 116 may be mounted to a second opposing (bottom) surface of substrate 120. Ground 112 for the antennas 40 in phased antenna array 60 may be formed from conductive traces within substrate 120 (e.g., conductive traces held at a ground or other reference potential).

While FIG. 9 shows two antennas, this is merely illustrative. In general, any desired number of antennas may be formed in phased antenna array 60. The example of antenna elements 110 being patch elements is merely illustrative. Antenna elements 110 may be dipole antenna resonating elements, Yagi antenna resonating elements, slot antenna resonating elements, or any other desired antenna resonating elements of antennas of any desired type.

The layers 122 in substrate 120 (FIG. 8) may include a first set of layers 122A (sometimes referred to herein as antenna layers 122A) and a second set of layers 122T (sometimes referred to herein as transmission line layers 122T). Antenna layers 122A may be vertically stacked over transmission line layers 122T. The conductive traces of ground 112 may be formed on a surface of transmission line layers 122T and may separate transmission line layers 122T from antenna layers 122A. Antenna layers 122A may include a single dielectric layer 122 (FIG. 8) or may include multiple dielectric layers 122. Transmission line layers 122T may include a single dielectric layer 122 (FIG. 8) or may include multiple dielectric layers 122.

Antenna layers 122A may support antennas 40 on module 118. Antenna layers 122A may have a thickness (height) Z1 extending from ground 112 to patch elements 110 (e.g., thickness Z1 may establish height H of FIGS. 6 and 7). Thickness Z1 may be, for example, 1 millimeter or less.

Transceiver circuitry 116 may include transceiver ports 124. Each transceiver port 124 may be coupled to a respective antenna 40 over a corresponding transmission line path 64 (FIGS. 4, 5, and 7). Ports 124 may include conductive contact pads, solder balls, microbumps, conductive pins, conductive pillars, conductive sockets, conductive clips, welds, conductive adhesive, conductive wires, interface circuits, or any other desired conductive interconnect structures.

Transmission line paths 64 for antennas 40 may be embedded within transmission line layers 122T. Transmission line paths 64 may include conductive traces 136 in transmission line layers 122T (e.g., conductive traces on a given dielectric layer within transmission line layers 122T). Conductive traces 136 may form signal conductor 94 and/or ground conductor 90 of one, more than one, or all of transmission lines 64 (FIG. 5) for the antennas 40 in phased antenna array 60. If desired, additional grounded traces within transmission line layers 122T and/or portions of ground 112 may form ground conductor 90 of the transmission lines (FIG. 5).

Conductive traces 136 may be coupled to the positive antenna feed terminals of antennas 40 (e.g., positive antenna feed terminals 98 of FIGS. 6 and 7) over vertical conductive structures 114. Conductive traces 136 may be coupled to transceiver ports 124 over vertical conductive structures 126. Vertical conductive structures 114 may extend through a portion of transmission line layers 122T, a hole or opening in ground 112, and antenna layers 122A to patch elements 110. Vertical conductive structures 126 may extend through a portion of transmission line layers 122T. Vertical conductive structures 126 and 114 may include conductive through-vias, metal pillars, metal wires, conductive pins, or any other desired vertical conductive interconnects.

Transmission line layers 122T may have a thickness (height) Z2 from the bottom surface of substrate 120 to ground 112. Thickness Z2 may be less than thickness Z1 of antenna layers 122A. In order to maximize isolation between the different transmission line paths formed from conductive traces 136 and conductive structures 126 and 114, transmission line layers 122T may be formed from a dielectric material having a relatively high dielectric permittivity DKH. Relatively high dielectric permittivity DKH may be defined by the particular material used to form transmission line layers 122T and may be, for example, between 6.0 and 8.0, between 6.5 and 7.5, between 5.0 and 9.0, greater than 4.5, or any other desired permittivity greater than 4.0. In one suitable arrangement, transmission line layers 122T may be formed using low-temperature co-fired ceramics (LTCC) or other ceramics/dielectrics having dielectric permittivity DKH.

Forming transmission line layers 122T using dielectric permittivity DKH may allow the conductive traces for each transmission line path to be routed more closely together with satisfactory electromagnetic isolation than in scenarios where lower dielectric permittivities are used. This may allow substrate 120 to accommodate a greater number of transmission lines to cover signals at a greater number of different millimeter and centimeter wave frequencies given the same unit volume than when lower dielectric permittivities are used (while still maintaining satisfactory electromagnetic isolation). As one example, transceiver circuitry 116 may convey radio-frequency signals using conductive traces 136 and phased antenna array 60 in a first frequency band (e.g., between 27.5 GHz and 28.5 GHz), a second frequency band (e.g., between 37 GHz and 41 GHz), and/or a third frequency band (e.g., between 57 GHz and 71 GHz) with satisfactory isolation (e.g., due to relatively high dielectric permittivity DKH).

In practice, forming the entirety of substrate 120 (e.g., both transmission line layers 122T and antenna layers 122A) from the same material (e.g., a material having dielectric permittivity DKH) may minimize the manufacturing complexity and cost of module 118. However, if antenna layers 122A were to be formed using material with dielectric permittivity DKH, an excessive amount of surface waves may be generated between antenna ground 112 and patch elements 110 and the corresponding reduction in thickness may undesirably deteriorate the bandwidth and efficiency of antennas 40. In order to minimize the generation of surface waves and maximize the efficiency and bandwidth of antennas 40, antenna layers 122A may be formed from a material that has a relatively low dielectric permittivity DKL (e.g., a different material than is used for transmission line layers 122T). Relatively low dielectric permittivity DKL is less than relatively high permittivity DKH and may be, for example, between 3.0 and 4.0, between 2.0 and 5.0, between 3.3 and 3.7, less than 4.0, less than 4.5, or any other desired permittivity less than permittivity DKH. In one suitable arrangement, transmission line layers 122T may be formed using low-temperature co-fired ceramics (LTCC) or other ceramics/dielectrics having dielectric permittivity DKL.

If desired, transmission line layers 122T and antenna layers 122A may be formed from materials having similar thermal properties (e.g., similar thermal expansion coefficients, heat transfer characteristics, etc.) and/or mechanical properties (e.g., similar stiffnesses, rigidities, etc.). For example, layers 122T and 122A may both be formed from ceramics such as LTCC (e.g., LTCC having different dielectric permittivities). Forming transmission line layers 122T and antenna layers 122A with similar thermal and/or mechanical properties may simplify the manufacturing cost and complexity of module 118. In this way, the transmission line paths used by phased antenna array 60 may be sufficiently isolated even as multiple millimeter and centimeter wave frequency bands are used without sacrificing bandwidth and efficiency for antennas 40 and while also minimizing the overall volume of module 118.

The example of FIG. 9 is merely illustrative. If desired, transceiver circuitry 116 may be formed at the top surface of substrate 120, may be embedded within substrate 120, or may be located elsewhere. Additional dielectric layers or protective coatings may be formed over patch elements 110 if desired. Other transmission line schemes, feeding schemes, and/or antenna types may be used if desired.

Figure 10:
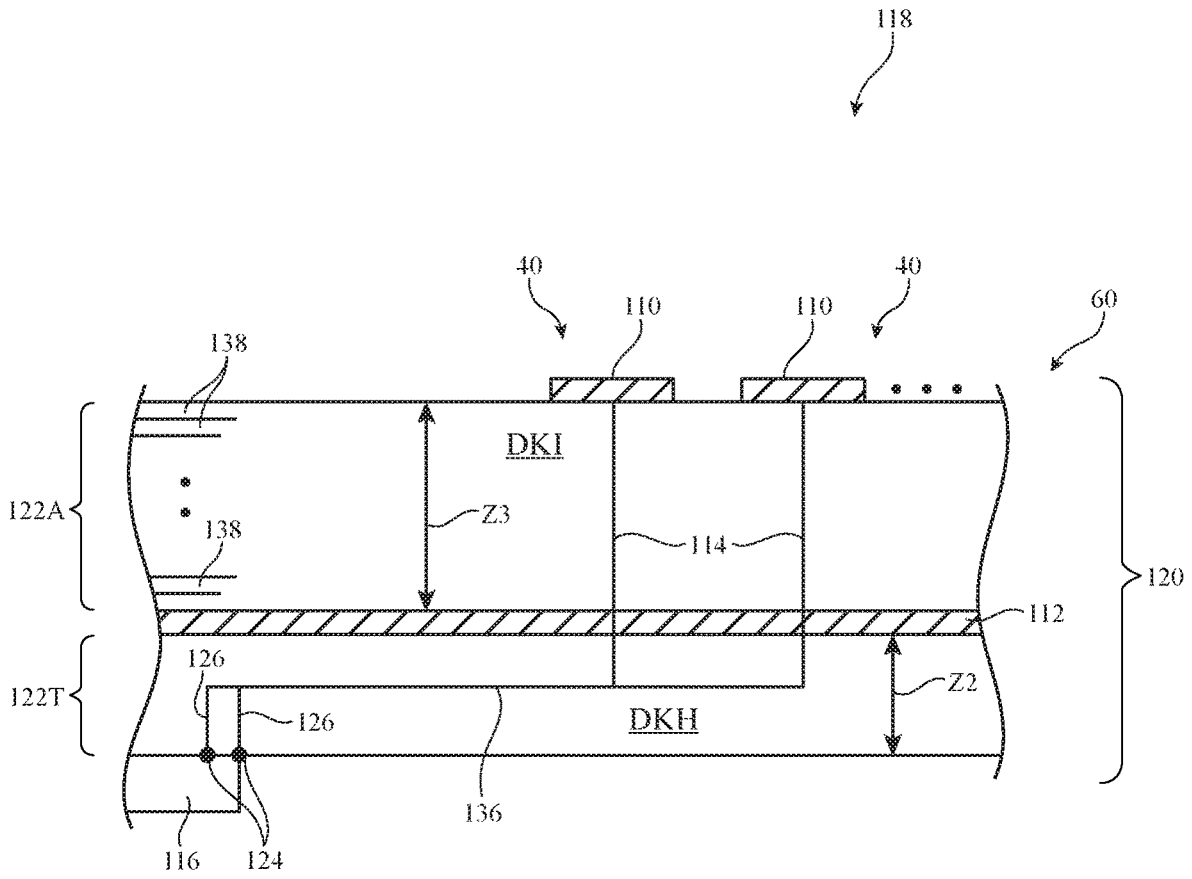
FIG. 10 is a cross-sectional side view of an illustrative antenna module having dielectric layers that exhibit a bulk permittivity defined by alternating layers of relatively high and relatively low dielectric permittivities in accordance with an embodiment.

If desired, some of the bandwidth and efficiency for antennas 40 may be sacrificed in order to further reduce the total thickness of substrate 120 (e.g., parallel to the Z-axis of FIG. 10). For example, the dielectric permittivity of antenna layers 122A may be increased to an intermediate dielectric permittivity that is greater than dielectric permittivity DKL but lower than dielectric permittivity DKH. This may reduce the thickness of antenna layers 122A to less than thickness Z1 of FIG. 9 (e.g., thereby minimizing the size of module 118 and allowing module 118 to fit into and accommodate different form factors for housing 12 of device 10).

In order to minimize manufacturing cost and expense, the same materials used to form antenna layers 122A and transmission line layers 122T may be used to form antenna layers having the intermediate dielectric permittivity. For example, antenna layers 122A may include alternating layers of dielectric material having dielectric permittivity DKH and layers of dielectric material having dielectric permittivity DKL. Collectively, the antenna layers may exhibit a bulk permittivity (e.g., a collective or effective dielectric permittivity) DKI that is greater than permittivity DKL but less than permittivity DKH. Dielectric permittivity DKI may sometimes referred to herein as intermediate dielectric permittivity DKI.

FIG. 10 is a cross-sectional side view of module 118 showing how antenna layers 122A may be formed from alternating layers of relatively low and relatively high dielectric permittivity material. As shown in FIG. 10, antenna layers 122A may include multiple individual stacked dielectric layers 138 (e.g., individual dielectric layers 122 as shown in FIG. 8). Layers 138 within antenna layers 122A may include a first set of layers each having relatively low dielectric permittivity DKL. This first set of layers may be interleaved or interposed among a second set of layers each having relatively high dielectric permittivity DKH. When configured in this way, antenna layers 122A may collectively exhibit intermediate dielectric permittivity DKI. Increasing the dielectric permittivity of antenna layers 122A may reduce the thickness of antenna layers 122A to thickness Z3 that is less than thickness Z1 and greater than thickness Z2 of FIG. 9. This may serve to sacrifice some of the bandwidth, efficiency, and/or gain of antennas 40 in exchange for a reduction in the size of module 118 (e.g., without deteriorating transmission line isolation for multiple frequency bands).

Figure 11:
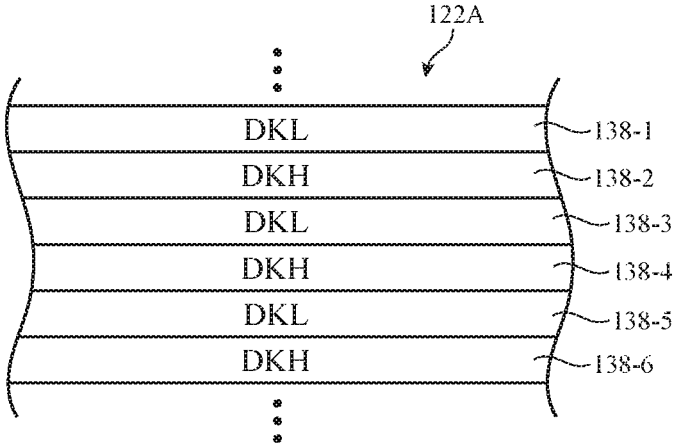
FIGS. 11-13 are cross-sectional side views of illustrative alternating layers of relatively high and relatively low dielectric permittivities that may be used in forming the antenna layers of an antenna module in accordance with an embodiment.
Figure 12:
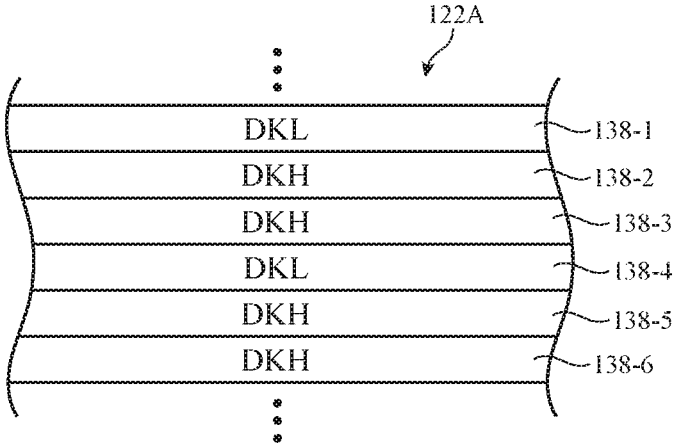
Figure 13:
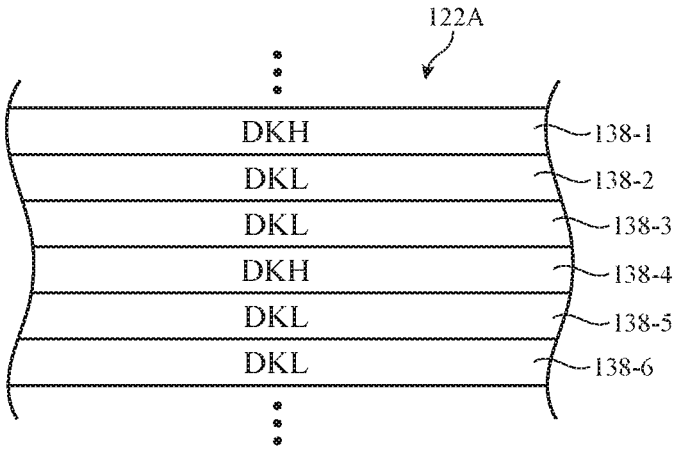

FIGS. 11-13 are cross-sectional side views showing how relatively low dielectric permittivity layers 138 may be interleaved among relatively high dielectric permittivity layers 138 within antenna layers 122A of FIG. 10. The layers 138 having relatively low dielectric permittivity DKL may sometimes be referred to collectively herein as a first set of layers 138. The layers 138 having relatively high dielectric permittivity DKH may sometimes be referred to collectively herein as a second set of layers 138.

As shown in the example of FIG. 11, the layers 138 in the first set may alternate with the layers 138 in the second set (e.g., the first set of layers may include layers 138-1, 138-3, and 138-5 whereas the second set of layers includes layers 138-2, 138-4, and 138-6). In this way, every-other layer 138 in antenna layers 122A may have low permittivity DKL or high permittivity DKH (e.g., there may be the same number of layers in the first and second sets). Collectively, layers 138 (i.e., antenna layers 122A) may exhibit intermediate dielectric permittivity DKI.

As shown in the example of FIG. 12, the layers 138 in the first set may be separated by two layers 138 in the second set (e.g., the first set of layers may include layers 138-1 and 138-4 whereas the second set of layers includes layers 138-2, 138-3, 138-5, and 138-6). In this way, every three layers 138 in antenna layers 122A may have low permittivity DKL. Arranging layers 138 in this manner may configure antenna layers 122A to exhibit a higher intermediate permittivity DKI than in the arrangement of FIG. 11 (e.g., because more high permittivity material is used in the arrangement of FIG. 12 than in the arrangement of FIG. 11).

As shown in the example of FIG. 13, the layers 138 in the second set may be separated by two layers 138 in the first set (e.g., the second set of layers may include layers 138-1 and 138-4 whereas the first set of layers includes layers 138-2, 138-3, 138-5, and 138-6). In this way, every three layers 138 in antenna layers 122A may have high permittivity DKH. Arranging layers 138 in this manner may configure antenna layers 122A to exhibit a lower intermediate permittivity DKI than in the arrangements of FIGS. 11 and 12 (e.g., because more low permittivity material is used in the arrangement of FIG. 13 than in the arrangements of FIGS. 11 and 12).

By selecting the desired number and arrangement of low and high permittivity layers 138 in antenna layers 122A, antenna layers 122A may be provided with any desired intermediate dielectric permittivity DKI (e.g., to allow module 118 to conform to a desired housing form factor with predetermined antenna efficiencies and without sacrificing transmission line isolation). The examples of FIGS. 11-13 are merely illustrative and, in general, any desired number of low and high permittivity layers 138 may be stacked or arranged in any desired order.

The foregoing is merely illustrative and various modifications can be made to the described embodiments. The foregoing embodiments may be implemented individually or in any combination.

What is claimed is:

1. An electronic device, comprising:

a first set of dielectric layers having a first dielectric permittivity;

a second set of dielectric layers stacked over the first set of dielectric layers and having a second dielectric permittivity that is less than the first dielectric permittivity;

a ground layer interposed between the first set of dielectric layers and the second set of dielectric layers, wherein the second set of dielectric layers has a first layer and a second layer, the first set of dielectric layers has a third layer that has a same dielectric permittivity as the first layer and that has a different dielectric permittivity than the second layer;

a phased antenna array formed on the second set of dielectric layers; and transceiver circuitry coupled to the phased antenna array and configured to convey radio-frequency signals at a frequency greater than 10 GHz using the phased antenna array.

2. The electronic device defined in claim 1, further comprising:

a plurality of transmission line structures, wherein the plurality of transmission line structures comprises conductive traces on the first set of dielectric layers, the ground layer is interposed between the conductive traces and the second set of dielectric layers, and the transceiver circuitry is configured to convey the radio-frequency signals over the plurality of transmission line structures.

3. The electronic device defined in claim 2, wherein the transceiver circuitry is mounted to the first set of dielectric layers.

4. The electronic device defined in claim 3, further comprising:

first vertical interconnects that extend through a first portion of the first set of dielectric layers between the transceiver circuitry and the conductive traces; and second vertical interconnects that extend through a second portion of the first set of dielectric layers, the ground layer, and the second set of dielectric layers between the conductive traces and positive antenna feed terminals on the phased antenna array.

5. The electronic device defined in claim 1, wherein the transceiver circuitry is configured to convey the radio-frequency signals at a first frequency band between 27.5 GHz and 28.5 GHz, a second frequency band between 37 GHz and 41 GHz, and a third frequency band between 57 GHz and 71 GHz using a plurality of transmission line structures and the phased antenna array.

6. The electronic device defined in claim 1, wherein the first set of dielectric layers has a first thickness and the second set of dielectric layers has a second thickness that is greater than the first thickness.

7. The electronic device defined in claim 1, wherein the first and second sets of dielectric layers comprise ceramic material.

8. The electronic device defined in claim 1, wherein the first dielectric permittivity is between 3.0 and 4.0 and the second dielectric permittivity is between 6.0 and 8.0.

9. An antenna module comprising:

a dielectric substrate having a set of transmission line layers and a set of antenna layers, wherein the set of transmission line layers has a first dielectric permittivity, the set of antenna layers has a second dielectric permittivity that is less than the first dielectric permittivity, the set of antenna layers comprises first and second layers, the set of transmission line layers comprises a third layer, and the first layer is interposed between the second and third layers, the third layer being formed from a same material as the first layer and being formed from a different material than a material from which the second layer is formed;

a phased antenna array, wherein the phased antenna array comprises antenna resonating elements mounted to the set of antenna layers, the phased antenna array being configured to transmit and receive radio-frequency signals at a frequency greater than 10 GHz; and a plurality of radio-frequency transmission lines, wherein the plurality of radio-frequency transmission lines comprises conductive traces that are formed on the set of transmission line layers and that are coupled to the antenna resonating elements.

10. The antenna module defined in claim 9, further comprising:

a ground plane interposed between the set of transmission line layers and the set of antenna layers, wherein the conductive traces are coupled to the antenna resonating elements through the ground plane and the set of antenna layers.

11. The antenna module defined in claim 10, further comprising:

transceiver circuitry mounted to the set of transmission line layers, the set of transmission line layers being interposed between the transceiver circuitry and the set of antenna layers.

12. The antenna module defined in claim 9, wherein the first layer has the first dielectric permittivity.

13. The antenna module defined in claim 12, wherein the second layer has a third dielectric permittivity that is less than the first dielectric permittivity.

14. The antenna module defined in claim 13, wherein the set of antenna layers further comprises a fourth layer having the first dielectric permittivity and a fifth layer having the third dielectric permittivity.

15. The antenna module defined in claim 14, wherein the second layer is interposed between the first and fourth layers and the fourth layer is interposed between the second and fifth layers.

16. The antenna module defined in claim 14, wherein the second and fifth layers are interposed between the first and fourth layers.

17. The antenna module defined in claim 14, wherein the first and fourth layers are interposed between the second and fifth layers.

18. Apparatus comprising:

a substrate having a dielectric layer, a first set of dielectric layers, and a second set of dielectric layers interleaved with the first set of dielectric layers, wherein the dielectric layer has a first dielectric permittivity, the first set of dielectric layers has the first dielectric permittivity, and the second set of dielectric layers has a second dielectric permittivity that is less than the first dielectric permittivity;

a ground plane interposed between the dielectric layer and the first and second sets of dielectric layers; and an array of antenna radiating elements mounted to the substrate and configured to convey radio-frequency signals at a frequency greater than 10 GHz, wherein the first and second sets of dielectric layers are interposed between the array and the ground plane.

19. The apparatus defined in claim 18, further comprising:

radio-frequency transceiver circuitry coupled to the array of antenna radiating elements, the dielectric layer having first and second opposing surfaces, the ground plane being formed at the first surface of the dielectric layer, and the radio-frequency transceiver circuitry being disposed at the second surface of the dielectric layer.

* * * * *